US008926897B2

(12) United States Patent
Harada et al.

(10) Patent No.: US 8,926,897 B2
(45) Date of Patent: Jan. 6, 2015

(54) NICKEL-BASE SUPERALLOY EXCELLENT IN THE OXIDATION RESISTANCE

(75) Inventors: Hiroshi Harada, Tsukuba (JP); Kyoko Kawagishi, Tsukuba (JP); Toshiharu Kobayashi, Tsukuba (JP); Yutaka Koizumi, Tsukuba (JP); Atsushi Sato, Tsukuba (JP)

(73) Assignee: National Institute for Materials Science, Ibaraki (JP)

( * ) Notice: Subject to any disclaimer, the term of this patent is extended or adjusted under 35 U.S.C. 154(b) by 993 days.

(21) Appl. No.: 11/992,308

(22) PCT Filed: Sep. 27, 2006

(86) PCT No.: PCT/JP2006/319183

§ 371 (c)(1),
(2), (4) Date: Jun. 5, 2008

(87) PCT Pub. No.: WO2007/037277

PCT Pub. Date: Apr. 5, 2007

(65) Prior Publication Data

US 2009/0196760 A1 Aug. 6, 2009

(30) Foreign Application Priority Data

Sep. 27, 2005 (JP) ..... 2005-280993

(51) Int. Cl.
*C22C 19/05* (2006.01)
*C22C 1/04* (2006.01)

(52) U.S. Cl.
CPC ..... *C22C 1/0433* (2013.01); *C22C 19/057* (2013.01); *B22F 2998/00* (2013.01)
USPC ..... 420/444; 148/404

(58) Field of Classification Search
CPC ..... C22C 19/057
USPC ..... 420/444; 148/410, 404
See application file for complete search history.

(56) References Cited

U.S. PATENT DOCUMENTS

| | | | | |
|---|---|---|---|---|
| 4,261,742 | A * | 4/1981 | Coupland et al. | 420/443 |
| 4,935,072 | A * | 6/1990 | Nguyen-Dinh | 148/562 |
| 2005/0260346 | A1 * | 11/2005 | Heng et al. | 427/248.1 |

FOREIGN PATENT DOCUMENTS

| | | | | |
|---|---|---|---|---|
| GB | 2 105 748 | * | 3/1983 | C22C 19/05 |
| JP | 2000-239771 | | 9/2000 | |
| JP | 2002-146460 | | 5/2002 | |
| JP | 2005-97649 | | 4/2005 | |
| JP | 2005-97650 | | 4/2005 | |
| WO | 03/080882 | | 10/2003 | |

OTHER PUBLICATIONS

English Abstract and English Machine Translation of JP 2005-097649 (2005).*

Yutaka, Koizumi et al., "Long-Term Creep Property of a Second-Generation Nickel-Base Single-Crystal Superalloy, TMS-82+", J. Japan Inst. Metals, vol. 69, No. 8 (2005), pp. 743-746 with English Abstract.

* cited by examiner

*Primary Examiner* — Jessee Roe
(74) *Attorney, Agent, or Firm* — Wenderoth, Lind & Ponack, L.L.P.

(57) ABSTRACT

A nickel-base superalloy having excellent oxidation resistance is provided. It is useful as high-temperature members such as turbine blades and turbine vanes for jet engines or gas turbines. The nickel-base superalloy has a composition containing Co: 0.1 to 15% by weight, Cr: 0.1 to 10% by weight, Mo: 0.1 to 4.5% by weight, W: 0.1 to 15% by weight, Al: 2 to 8% by weight, Ta+Nb+Ti: 0 to 16% by weight, Hf: 0 to 5% by weight, Re: 0.1 to 16% by weight, Ru: 0.1 to 16% by weight, Si: 0.2 to 5% by weight and a balance made of Ni and unavoidable impurities.

12 Claims, 3 Drawing Sheets

NICKEL-BASE SUPERALLOY EXCELLENT IN THE OXIDATION RESISTANCE

TECHNICAL FIELD

The invention relates to a nickel-base superalloy, in more detail, to a novel nickel-base superalloy that is excellent in the oxidation resistance at high temperatures and suitable as members that are used under high temperature and high pressure such as turbine blades, turbine vanes, turbine discs and so on of jet engines, gas turbines and so on.

BACKGROUND ART

A nickel-base superalloy, when it is used in a base material as a turbine blade or a turbine vane of a jet engine or the like, in many cases, is used with a surface of a base material coated to inhibit high temperature oxidation and heating. In this connection, even when the coating is peeled off for some reason, the nickel-base superalloy is expected to be an alloy excellent in the oxidation resistance so that an apparatus may not be immediately destroyed due to oxidation and may be used until a periodic inspection.

Among conventional nickel-base superalloys, a Rene N5 alloy (an alloy made of Co: 8% by weight, Cr: 7% by weight, Mo: 2% by weight, W: 5% by weight, Al: 6.2% by weight, Ta: 7% by weight, Hf: 0.2% by weight, Re: 3% by weight and Ni as a balance) is known as an alloy excellent in the oxidation resistance (see patent literature 1).

However, with a recent advance in jet engines and gas turbines, a fuel gas temperature becomes further higher. Accordingly, a nickel-base superalloy having further excellent oxidation resistance is expected to realize.

Patent literature 1: U. K. Patent No. GB-2235697A

DISCLOSURE OF THE INVENTION

Problem to be Solved by the Invention

The present invention was been made in view of the above-mentioned situations and intends to provide a nickel-base superalloy that is excellent in the oxidation resistance and useful as high temperature members such as turbine blades, turbine vanes and so on of jet engines and gas turbines.

Means for Solving the Problems

The nickel-base superalloy of the invention is characterized by including, as means for overcoming the problems, the followings.

Firstly, as an alloy composition, a composition includes Co: 0.1 to 15% by weight, Cr: 0.1 to 10% by weight, Mo: 0.1 to 4.5% by weight, W: 0.1 to 15% by weight, Al: 2 to 8% by weight, Ta+Nb+Ti: 0 to 16% by weight, Hf: 0 to 5% by weight, Re: 0.1 to 16% by weight, Ru: 0.1 to 16% by weight, Si: 0.2 to 5% by weight and a balance made of Ni and unavoidable impurities.

Secondly, in the alloy of the first invention, a composition includes Co: 3 to 10% by weight, Cr: 1 to 6% by weight, Mo: 0.5 to 4.5% by weight, W: 2 to 10% by weight, Al: 4 to 7% by weight, Ta+Nb+Ti: 0 to 10% by weight or less, Hf: 0 to 2% by weight, Re: 1 to 10% by weight, Ru: 1 to 8% by weight, Si: 0.2 to 3% by weight and a balance made of Ni and unavoidable impurities.

Thirdly, in the alloy of the first invention, a composition includes Co: 4 to 8% by weight, Cr: 2 to 4% by weight, Mo: 1 to 4% by weight, W: 4 to 8% by weight, Al: 4 to 7% by weight, Ta+Nb+Ti: 1 to 8% by weight, Hf: 0.05 to 0.5% by weight, Re: 3 to 8% by weight, Ru: 3 to 7% by weight, Si: 0.4 to 2.5% by weight and a balance made of Ni and unavoidable impurities.

Fourthly, in the alloy of any one of the first through third inventions, a composition further includes any one kind or two or more kinds of elements of V: 3% by weight or less, Zr: 3% by weight or less, C, 0.3% by weight or less, B: 0.2% by weight or less, Y: 0.2% by weight or less, La: 0.2% by weight or less and Ce: 0.2% by weight or less.

Fifthly, a turbine component such as a turbine blade, a turbine vane or the like is produced according to a standard casting process, a unidirectional solidifying process, a single crystal solidifying process, a powder metallurgy process, a forging process or the like with an alloy of any one of the first through fourth inventions.

According to the invention, in a circumstance where, as a jet engine or a gas turbine advances, a fuel gas temperature becomes higher, a nickel-base superalloy having more excellent oxidation resistance can be provided. So far, particularly when a fuel gas temperature is made higher, the oxidation resistance is particularly problematic. However, since the alloy of the invention is a nickel-base superalloy in which the oxidation resistance at high temperatures is taken into consideration in particular, the above-mentioned existing problems can be improved.

A turbine blade or a turbine vane of a jet engine, a gas turbine or the like is used under high temperatures. Therefore, normally, on a surface of the member, a coating is applied to impart the heat resistance and oxidation resistance. However, when, for some reason, a coating layer is peeled, it is desirable that an exposed nickel-base superalloy may be used until a time of a next machine inspection without deteriorating within a short period due to the high temperature oxidation or the like. Furthermore, in general, since a turbine blade and a turbine vane are exposed to a high temperature, a lot of small holes are formed to apply inside cooling and cooling of a blade surface. The small holes, when these are clogged due to the high temperature oxidation, in some cases, are locally heated to be incapable of enduring the centrifugal force to collapse.

Furthermore, owing to the inside cooling, in some cases, a thickness of a member of a nickel-base superalloy becomes substantially 0.5 mm to be particularly problematic in the oxidation resistance. The nickel-base superalloy of the invention is excellent in the oxidation resistance; accordingly, the nickel-base superalloy, when used as a turbine blade or a turbine vane of a jet engine, a gas turbine and so on under a high temperature condition, can be used for a long time to be economically advantageous.

BEST MODE FOR CARRYING OUT THE INVENTION

Figure 1:
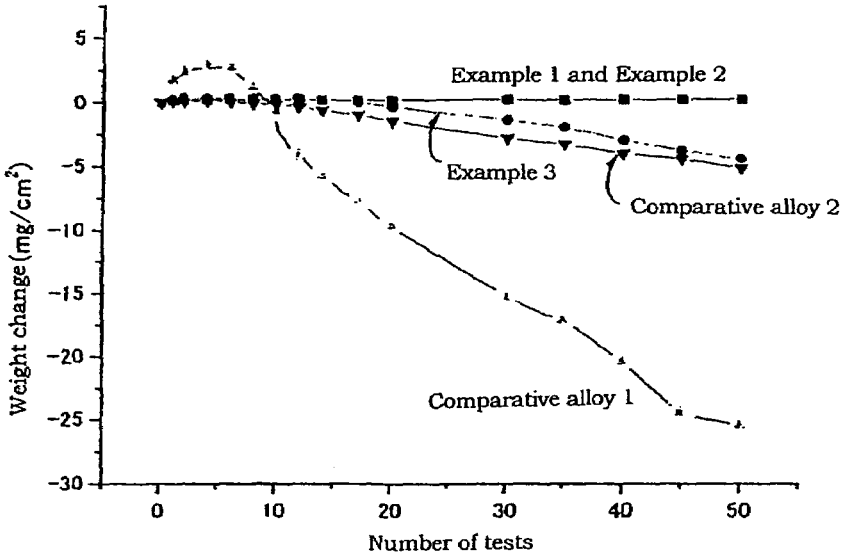
FIG. 1 is a diagram showing results of oxidation tests (repetition of heating at 1100° C. and holding there for 1 hr in air) of examples 1 through 3.

The invention has features as mentioned above. Embodiments thereof will be described below.

Limiting reasons of an alloy element composition of a nickel-base superalloy of the invention is as follows.

In the beginning, Co is effective in the stabilization of a structure and in an improvement in the mechanical strength. However, when Co is added more than 15% by weight, an amount of a gamma prime phase is reduced at high temperatures to result in a decrease in the mechanical strength; accordingly, it is set in the range of 0.1 to 15% by weight, preferably in the range of 3 to 10% by weight and most preferably in the range of 4 to 8% by weight.

In the next place, Cr is effective in an improvement in the corrosion resistance. An addition amount of Cr is set in the range of 0.1 to 10% by weight. When the addition amount of Cr exceeds 10% by weight, a detrimental phase is generated to lower the high temperature strength. Accordingly, the addition amount of Cr is set preferably in the range of 1 to 6% by weight and most preferably in the range of 2 to 4% by weight.

Then, Mo is set in the range of 0.1 to 4.5% by weight. Mo forms a solid solution in a base material to elevate high temperature strength and contributes to, due to the precipitation hardening, high temperature strength. Mo is preferably added in the range of 0.5 to 4.5% by weight and most preferably in the range of 1 to 4% by weight.

Next, W has effects of, similarly to Mo, the solid-solution hardening and the precipitation hardening. W is added in the range of 0.1 to 15% by weight, preferably in the range of 2 to 10% by weight and most preferably in the range of 4 to 8% by weight.

Then, Al, in combination with Ni, forms an intermetallic compound expressed by $Ni_3Al$, which constitutes a gamma prime phase that precipitates in a gamma host phase, to improve the high temperature strength. An addition amount is set in the range of 2 to 8% by weight and preferably in the range of 4 to 7% by weight.

In the next place, any one of Ta+Nb+Ti is an element that is effective in intensifying a gamma prime phase to improve the creep strength. In any case, when a sum total thereof is 16% by weight or more, a detrimental phase is promoted to grow; accordingly, the sum total thereof is set necessarily in the range of 0 to 16% by weight, preferably in the range of 0 to 10% by weight and most preferably in the range of 1 to 8% by weight.

Then, Hf is effective in improving the oxidation resistance and is effectively added in an alloy of the invention. However, when Hf is added exceeding 5% by weight, a detrimental phase is promoted to grow; accordingly, Hf is added necessarily 5% by weight or less, that is, necessarily in the range of 0 to 5% by weight, preferably in the range of 0 to 2% by weight and most preferably in the range of 0.05 to 0.5% by weight.

Next, Re dissolves in a gamma phase to improve high temperature strength due to the solid-solution strengthening. Furthermore, Re effectively improves the corrosion resistance. On the other hand, when Re is added too much, a TCP phase precipitates at high temperatures to be likely to lower the high temperature strength. Accordingly, Re is added preferably in the range of 0.1 to 16% by weight, more preferably in the range of 1 to 10% by weight and most preferably in the range of 3 to 8% by weight.

Then, Ru inhibits a TCP phase from precipitating to improve the high temperature strength. A composition ratio of Ru is preferably in the range of 0.1 to 16% by weight, preferably in the range of 1 to 8% by weight and most preferably in the range of 3 to 7% by weight.

In the next place, Si is an element that forms a protective oxide film such as $Al_2O_3$ on an alloy surface to improve the oxidation resistance. When Si is added much, the solubility limits of other elements are lowered; accordingly, an addition amount of Si is set in the range of 0.2 to 5% by weight, preferably in the range of 0.2 to 3% by weight and most preferably in the range of 0.4 to 2.5% by weight.

Then, V is an element that dissolves in a gamma prime phase to strengthen the gamma prime phase. However, when V is added too much, the creep strength is lowered; accordingly, an addition amount of V is specified to 3% by weight or less.

Next, Zr is an element that strengthens a grain boundary similarly to B and C. However, when Zr is added too much, the creep strength is lowered; accordingly, an addition amount of Zr is specified to 3% by weight or less.

In the next place, C contributes to grain boundary strengthening. However, when C is added too much, the ductility is damaged; accordingly, an addition amount of C is specified to 0.3% by weight or less.

Then, B, similarly to C, contributes to grain boundary strengthening. However, when B is added too much, the ductility is damaged; accordingly, an addition amount of B is specified to 0.2% by weight or less.

Next, Y, La or Ce is an element that improves the adhesiveness of a protective oxide film that forms alumina, chromia or the like when a nickel-base superalloy is used at high temperatures. However, when these are used too much, the solubility limits of other elements are lowered; accordingly, Y is specified to be 0.2% by weight or less, La is specified to be 0.2% by weight or less, and Ce is specified to be 0.2% by weight or less.

A nickel-base superalloy of the invention, which is mentioned above and excellent in the oxidation resistance, in consideration of procedures and conditions of so far known producing processes, can be produced by conventional cast alloy, a directionally solidified alloy, a single crystal superalloy and so on.

In what follows, examples will be described. It goes without saying that the invention is not restricted to the examples below.

Examples

In the beginning, nickel-base alloys having the respective compositions shown in Table 1 were melted.

TABLE 1

| | Composition (Ni: Bal. % by weight) | | | | | | | | | |
|---|---|---|---|---|---|---|---|---|---|---|
| | Co | Cr | Mo | W | Al | Hf | Re | Ru | Ta | Si |
| Example 1 | 5.8 | 2.9 | 2.9 | 5.8 | 5.8 | 0.1 | 7.2 | 5.2 | 0 | 1.9 |
| Example 2 | 5.8 | 2.9 | 2.9 | 5.8 | 5.8 | 0.1 | 7.1 | 5.2 | 1.4 | 1.4 |
| Example 3 | 5.7 | 2.8 | 2.8 | 5.7 | 5.7 | 0.1 | 7.0 | 5.1 | 2.8 | 1.0 |
| Comparative Example 1 | 5.6 | 2.8 | 2.8 | 5.6 | 5.6 | 0.1 | 6.9 | 5.0 | 5.6 | 0 |
| Comparative Example 2 | 8.0 | 7.0 | 2.0 | 5.0 | 6.2 | 0.2 | 3.0 | 0 | 7.0 | 0 |

With each of the obtained alloys, a sample having a diameter of 9 mmϕ and a height of 5 mm was prepared. The samples were used to evaluate the oxidation resistance.

The oxidation resistance test was carried out in air at a test temperature of 1100° C. The sample was, after holding at the test temperature for 1 hr, taken out of a furnace. The sample was cooled and a weight change thereof was measured. Thereafter, the sample was repeated to measure, after holding once more at the test temperature for 1 hr, a weight change.

As the result, as shown in FIG. 1, within a range of 50 times of the number of tests, in examples 1, 2 and 3, which contain Si, noble nickel-base superalloys that have the oxidation resistance exceeding that of a comparative alloy 2 (Rene N5) that has been said excellent in the oxidation resistance were found. The comparative alloy 1 that does not contain Si is poor in the oxidation resistance.

Figure 2:
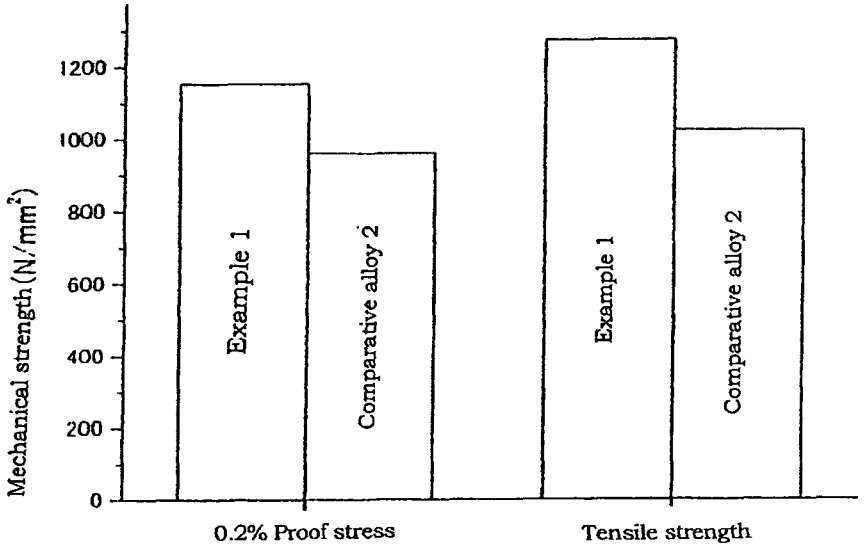
FIG. 2 is a diagram showing results of tensile tests at a test temperature of 400° C. of examples 1 and 2.

The tensile test was carried out at 400° C. of example 1 and comparative example 2. As the results thereof, as shown in FIG. 2, the superalloy of the invention had the mechanical strength more excellent than that of comparative example 2 in both of the 0.2% proof stress and the tensile strength.

As an example 4, a nickel-base alloy made of Co: 5.8% by weight, Cr: 3.2% by weight, Mo: 2.8% by weight, W: 5.6% by weight, Al: 5.7% by weight, Hf: 0.1% by weight, Re: 5.8% by weight, Ru: 3.6% by weight, Ta: 5.6% by weight, Si: 0.45% by weight and a balance made of Ni and unavoidable impurities was melted. As a comparative alloy 3, a nickel-base alloy that does not contain Si but contains Co: 5.8% by weight, Cr: 3.2% by weight, Mo: 2.8% by weight, W: 5.6% by weight, Al: 5.7% by weight, Hf: 0.1% by weight, Re: 5.8% by weight, Ru: 3.6% by weight, Ta: 5.6% by weight and a balance made of Ni and unavoidable impurities was melted.

Figure 3:
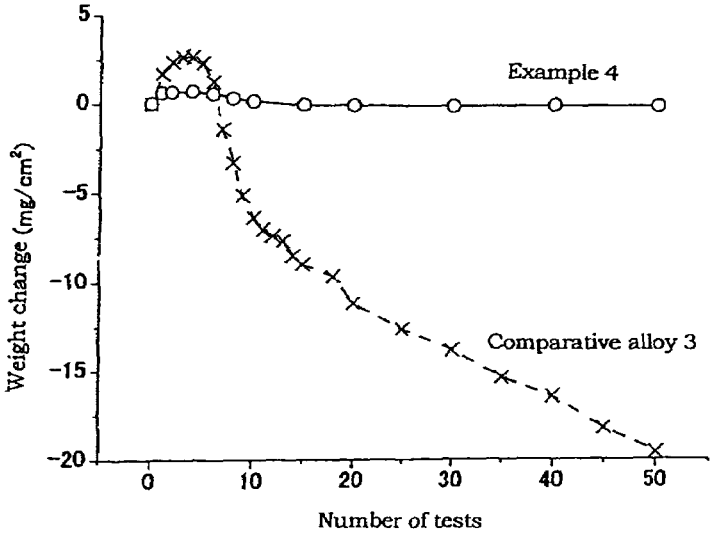
FIG. 3 is a diagram showing results of oxidation tests (repetition of heating at 1100° C. and holding there for 1 hr in air) of example 4.

The oxidation resistance test similar to that of examples 1 through 3 was carried out. As shown in FIG. 3, also in the nickel-base superalloy that contains 0.45% by weight of Si, in comparison with comparative alloy 3 that does not contain Si, the oxidation resistance was considerably improved.

The invention claimed is:

1. A nickel-base superalloy, having a composition that includes Co: 0.1 to 15% by weight, Cr: 0.1 to 4% by weight, Mo: 0.1 to 4% by weight, W: 0.1 to 15% by weight, Al: 2 to 8% by weight, Ta+Nb+Ti: 0 to 16% by weight, Hf: 0 to 5% by weight, Re: 0.1 to 16% by weight, Ru: 0.1 to 16% by weight, Si: 0.4 to 5% by weight and a balance made of Ni and unavoidable impurities.

2. A turbine blade or a turbine vane, produced according to a casting process, a directional solidifying process, a single crystal solidifying process, a powder metallurgy processor a forging process, with the nickel-base superalloy of claim 1.

3. The nickel-base superalloy of claim 1, further including singularly or in combination any one of elements of V: 3% by weight or less, Zr: 3% by weight or less, C: 0.3% by weight or less, B: 0.2% by weight or less, Y: 0.2% by weight or less, La: 0.2% by weight or less and Ce: 0.2% by weight or less.

4. A turbine blade or a turbine vane, produced according to a casting process, a directional solidifying process, a single crystal solidifying process, a powder metallurgy process or a forging process, with the nickel-base superalloy of claim 3.

5. The nickel-base superalloy of claim 1, having a composition that includes Co: 4 to 8% by weight, Cr: 2 to 4% by weight, Mo: 1 to 4% by weight, W: 4 to 8% by weight, Al: 4 to 7% by weight, Ta+Nb+Ti: 1 to 8% by weight, Hf: 0.05 to 0.5% by weight, Re: 3 to 8% by weight, Ru: 3 to 7% by weight, Si: 0.4 to 2.5% by weight and a balance made of Ni and unavoidable impurities.

6. A turbine blade or a turbine vane, produced according to a casting process, a directional solidifying process, a single crystal solidifying process, a powder metallurgy process or a forging process, with the nickel-base superalloy of claim 5.

7. The nickel-base superalloy of claim 5, further including singularly or in combination any one of elements of V: 3% by weight or less, Zr: 3% by weight or less, C: 0.3% by weight or less, B: 0.2% by weight or less, Y: 0.2% by weight or less, La: 0.2% by weight or less and Ce: 0.2% by weight or less.

8. A turbine blade or a turbine vane, produced according to a casting process, a directional solidifying process, a single crystal solidifying process, a powder metallurgy process or a forging process, with the nickel-base superalloy of claim 7.

9. The nickel-base superalloy of claim 1, having a composition that includes Co: 3 to 10% by weight, Cr: 1 to 4% by weight, Mo: 0.5 to 4% by weight, W: 2 to 10% by weight, Al: 4 to 7% by weight, Ta+Nb+Ti: 0 to 10% by weight, Hf: 0 to 2% by weight, Re: 1 to 10% by weight, Ru: 1 to 8% by weight, Si: 0.4 to 3% by weight and a balance made of Ni and unavoidable impurities.

10. A turbine blade or a turbine vane, produced according to a casting process, a directional solidifying process, a single crystal solidifying process, a powder metallurgy process or a forging process, with the nickel-base superalloy of claim 9.

11. The nickel-base superalloy of claim 9, further including singularly or in combination any one of elements of V: 3% by weight or less, Zr: 3% by weight or less, C: 0.3% by weight or less, B: 0.2% by weight or less, Y: 0.2% by weight or less, La: 0.2% by weight or less and Ce: 0.2% by weight or less.

12. A turbine blade or a turbine vane, produced according to a casting process, a directional solidifying process, a single crystal solidifying process, a powder metallurgy process or a forging process, with the nickel-base superalloy of claim 11.

* * * * *